US005287126A

United States Patent [19]

Quate

[11] Patent Number: 5,287,126

[45] Date of Patent: Feb. 15, 1994

[54] VACUUM CLEANER FOR ACOUSTIC INK PRINTING

[75] Inventor: Calvin F. Quate, Stanford, Calif.

[73] Assignee: Xerox Corporation, Stamford, Conn.

[21] Appl. No.: 893,300

[22] Filed: Jun. 4, 1992

[51] Int. Cl.[5] ..... B41J 2/185

[52] U.S. Cl. ..... 346/140 R

[58] Field of Search ..... 346/140 R, 75; 400/126

[56] References Cited

U.S. PATENT DOCUMENTS

| | | | |
|---|---|---|---|
| 3,776,461 | 12/1973 | Kashio | 239/3 |
| 4,317,124 | 2/1982 | Shirato et al. | 346/140 R |
| 4,367,479 | 1/1983 | Bower | 346/140 R |
| 4,542,389 | 9/1985 | Allen | 346/140 R |
| 4,851,863 | 7/1989 | Yamamori et al. | 346/140 R |
| 5,121,141 | 6/1992 | Hadimoglu et al. | 346/140 R |
| 5,155,498 | 10/1992 | Roy et al. | 346/1.1 |
| 5,184,147 | 2/1993 | MacLane et al. | 346/1.1 |

*Primary Examiner*—Benjamin R. Fuller
*Assistant Examiner*—N. Le
*Attorney, Agent, or Firm*—John M. Kelly

[57] ABSTRACT

A vacuum cleaner for helping maintain the cleanliness of the exposed surfaces of an ink jet droplet ejector. The vacuum cleaner is comprised of a top cover plate, having a plurality of air passages, that is located over a channel surface by spacers. A vacuum means draws the pressure in the defined volume between the top cover plate, the channel surface, and the spacers below the external pressure, whereby air is drawn into the defined volume through the air passages. The resulting air flow removes ink, dust, and debris from the vicinity of the exposed surfaces, thereby helping to maintain the cleanliness of the droplet ejector. The top cover plate and spacers are beneficially formed using silicon microstructure fabrication techniques.

4 Claims, 1 Drawing Sheet

VACUUM CLEANER FOR ACOUSTIC INK PRINTING

The present invention relates to techniques for maintaining the cleanliness of exposed surfaces in ink jet print heads.

BACKGROUND OF THE PRESENT INVENTION

Various ink jet printing technologies have been or are being developed. One such technology, referred to hereinafter as acoustic ink printing (AIP), uses acoustic energy to produce an image on a recording medium. While more detailed descriptions of the AIP process can be found in U.S. Pat. Nos. 4,308,547, 4,697,195, and 5,028,937, essentially, bursts of acoustic energy focused near the free surface of a liquid ink cause ink droplets to be ejected onto a recording medium.

Because the dimensions of the droplet ejectors used in acoustic ink printing are small, their cleanliness is extremely important. Not only can dirt particles and dust (particularly paper dust) clog the ejector ports, but ejected ink droplets which do not adhere to the recording medium can build up enough to disrupt the printing process.

While cleanliness may be a problem with the other types of ink jet printers, such printers usually use a small, moving print head that is readily wiped clean, such as before or after the printing of each print line. However, in AIP it is contemplated that a fixed print head that spans the print line and contains thousands of individual droplet ejectors will be used. To print an image with such a print head, the recoding medium passes by the print head as droplets are ejected onto the recording medium. As can be appreciated, it is difficult to clean such a large, fixed print head by wiping, particularly with a low cost, nondestructive system that does not disrupt the printing cycle.

Therefore, a non-wiping technique for improving the cleanliness of the exposed surfaces of the droplet ejectors of a fixed print head would be beneficial.

SUMMARY OF THE INVENTION

In accordance with the present invention there is provided a vacuum cleaner for helping maintain the cleanliness of the exposed surfaces of a print head. The vacuum cleaner includes a top cover plate with a plurality of air passages (beneficially formed via anisotropic etching) that is positioned above a channel surface using spacers. The top cover plate, spacers, and channel surface define a volume that is pumped by a vacuum means to a pressure lower then that of the external environment. The pressure difference causes air, dirt, debris, and excess ink droplets to be drawn through the air passages and into the volume, thereby helping to maintain the cleanliness of the exposed surfaces.

BRIEF DESCRIPTION OF THE DRAWINGS

Other aspects of the present invention will become apparent as the following description proceeds and upon reference to the following drawing.

DETAILED DESCRIPTION OF THE ILLUSTRATED EMBODIMENT

Figure 1:
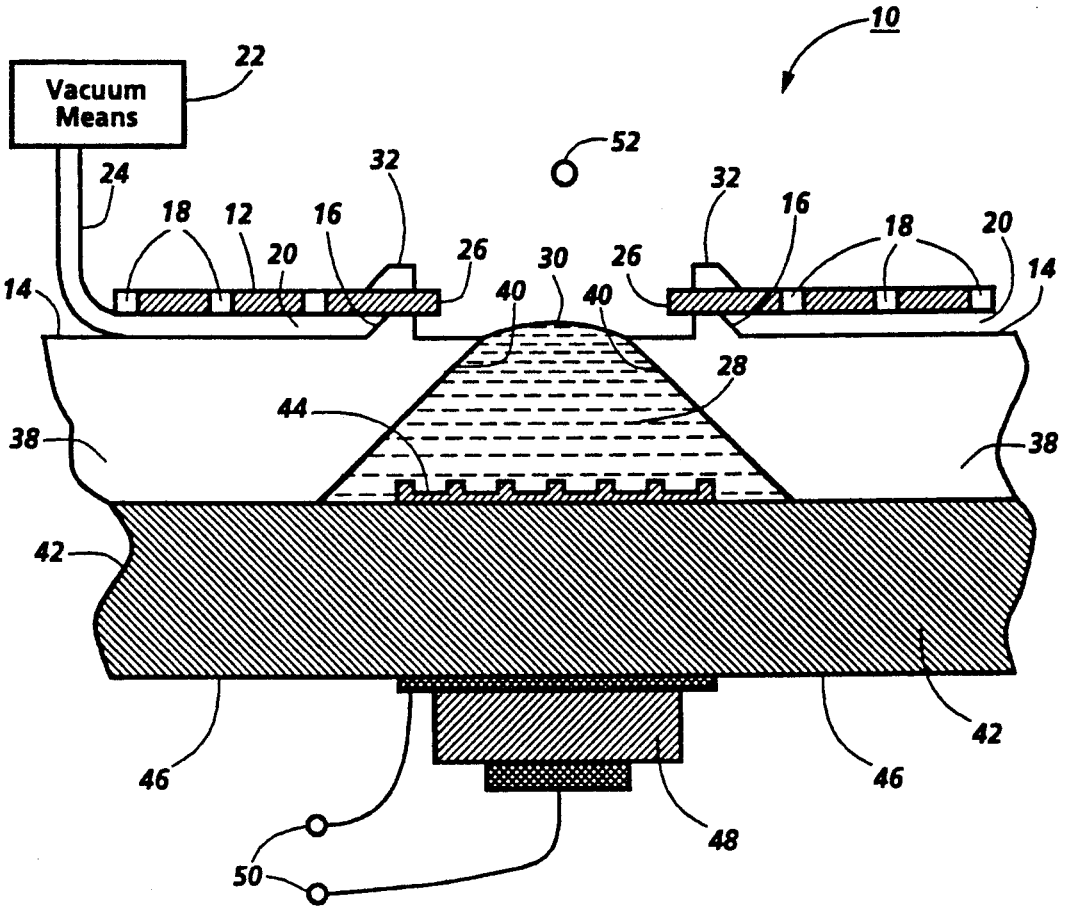
FIG. 1 shows a simplified, enlarged, cross-sectional view of an acoustic ink jet droplet ejector that incorporates an embodiment of the present invention.

While the present invention is described in connection with an acoustic ink jet droplet ejector, it is to be clearly understood that the present invention is not intended to be limited to the illustrated embodiment or to that application. On the contrary, the present invention is intended to cover all alternatives, modifications, equivalents, and uses as may be included within the scope of the appended claims.

Refer now to FIG. 1 where an acoustic droplet ejector 10 incorporating the present invention is shown. It is to be understood that the droplet ejector 10 is substantially cylindrical (when viewed from the top down) and that it is only one of many substantially identical droplet ejectors that are fabricated into rows of droplet ejectors (at about 75 droplet ejectors per inch) which form fixed AIP print head.

The droplet ejector 10 includes a top cover plate 12 that is spaced above a substantially flat channel surface 14 by a circular spacer 16 (shown in two parts in the cross-sectional view of FIG. 1). In practice, all of the droplet ejectors in the print head share a common top cover plate 12 and a common channel surface 14. However, each droplet ejector has its own spacer 16. The top cover plate includes a plurality of small air passages 18 which connect the volume 20 defined between the top cover plate, the channel surface 14, and the spacer 16 to the external environment. A vacuum means 22, via a connection 24, draws the pressure in the volume 20 below that of the external environment, thereby drawing air through the air passages and into the volume. The top cover plate 12 also includes an opening 26 within the spacer 16 which allows droplets of an ink 28 to be ejected from the free surface 30 of ink in an ink well (see below). Surrounding the opening 26 of the top cover plate is a circular lip 32 (shown in two parts in the cross-sectional view of FIG. 1). The lip forms a barrier which helps prevent material on the top cover plate from falling into the opening 26.

The previously mentioned channel surface 14 is actually the front surface of a silicon body 38. The silicon body includes a conically shaped opening 40 that forms the side wall of the ink well that holds the ink 28. As shown in FIG. 1, the openings 26 and 40 are axially aligned. The bottom of the ink well is formed by a glass substrate 42 to which the silicon body 38 attaches. On the glass substrate and within the ink well is located an acoustic lens 44. Axially aligned with the ink well and attached, both physically and acoustically, to the back side 46 of the glass substrate 42 is a ZnO transducer 48 with electrical contacts 50.

To eject an ink droplet 52, RF energy is applied to the transducer 48 via the electrical contacts 50. The resulting acoustic energy passes through the glass substrate 42 to the acoustic lens 44, which focuses the acoustic energy into a small focal area near the free surface 30 of the ink 28. In response to the acoustic energy, a droplet 52 is ejected.

The vacuum cleaner formed by the top cover plate 12, channel surface 14, spacer 16, air passages 18, vacuum means 22, and their related structures helps to keep the exposed surfaces of the droplet ejector clean. For example, consider a droplet that is ejected, but that does not adhere to the recording medium and falls back toward the droplet ejector. Air drawn into the air passages 18 creates an air flow which tends to draw the droplet toward the air passages and away from the opening 26. If the droplet does reach the top cover plate 12, it (1) will be prevented from moving into the opening 26 by the lip 32, and (2) will be drawn into the volume 20. The air flow also draws dirt and debris, such as paper dust, that approaches the air passages 18 into the volume. Thus, the effect of the air flow is to help maintain the cleanliness of the individual droplet ejectors, and thus the print head.

The structures of the vacuum cleaner are beneficially formed using techniques well known to those that specialize in fabricating microstructures in silicon. For example, the vacuum cleaner structures can be formed by depositing a polysilicon layer over a sacrificial layer that is itself deposited over the silicon base 38. The air passages 18 (each air passage being about 20 to 50 microns in diameter) are then formed by etching of the polysilicon layer and the lip 32 can then be formed by depositing additional material on the top cover plate. Most of the sacrificial layer is then etched away, leaving the spacers 16 to support the polysilicon layer, now the top cover plate 12, over the silicon body 38.

From the foregoing, numerous modifications and variations of the principles of the present invention will be obvious to those skilled in its art. Therefore the scope of the present invention is to be defined by the appended claims.

What is claimed is:

1. A droplet ejector comprised of:

an ink well for holding a marking fluid so that said marking fluid has a free surface;

a body proximate said ink well and having a channel surface;

a top cover plate having a plurality of air passages and an opening;

spacer for holding said top cover plate in a spaced apart relationship to said channel surface such that said opening substantially axially aligns with said ink well and such that a volume is defined between said top cover plate and said channel surface; and vacuum means for drawing air, dirt, debris, and ink droplets through said air passages and into said defined volume.

2. The droplet ejector according to claim 1, further including a lip attached to said top cover plate and surrounding said opening.

3. The droplet ejector according to claim 1 wherein said top cover plate is silicon and wherein said air passages are formed by an etching process.

4. The droplet ejector according to claim 1, further including:

an ultrasonic transducer for converting applied electrical energy into acoustic energy;

means for focusing said acoustic energy so that said acoustic energy passes through said ink well and for focusing said acoustic energy into an area near said free surface; and means for applying electrical energy to said transducer so that said focused acoustic energy causes an ink droplet to be ejected from said free surface and to pass through said opening.

* * * * *